United States Patent [19]

Bolis

[11] 4,029,378

[45] June 14, 1977

[54] ELECTRIFIED CHANNEL WITH CORRESPONDING SNAP ACTING CONNECTOR

[75] Inventor: Edoardo Bolis, Milan, Italy

[73] Assignee: ITT Industries, Inc., New York, N.Y.

[22] Filed: Mar. 11, 1976

[21] Appl. No.: 665,842

[52] U.S. Cl. ..... 339/22 B; 339/91 R

[51] Int. Cl.[2] ..... H01R 13/60

[58] Field of Search ..... 339/22 R, 22 B, 91 R

[56] References Cited

UNITED STATES PATENTS

| | | | |
|---|---|---|---|
| 2,883,637 | 4/1959 | Born | 339/22 B |

FOREIGN PATENTS OR APPLICATIONS

| | | | |
|---|---|---|---|
| 1,220,077 | 1/1960 | France | 339/22 B |
| 675,111 | 7/1952 | United Kingdom | 339/22 B |

*Primary Examiner*—Roy Lake

*Assistant Examiner*—E. F. Desmond

*Attorney, Agent, or Firm*—John T. O'Halloran; Thomas M. Marshall

[57] ABSTRACT

The electrified channel and corresponding snap acting connector of this invention provides for aligned conductors, preferably in the form of bus bars, secured to an insulation body carried by a channel. A mating or corresponding connector includes elastically mounted contacts carried in a housing which has a pair of spring elements on its exterior designed to retain the connector body with the contacts making contact with the conductors. When the contacts are in contact with the conductors they are spring pressed against them. A pair of external shoulder members, which are external to the channel when the connector is in place, can be moved inwardly to engage the spring clips thus permitting the connector to be removed from the channel with the spring pressure on the contacts assisting withdrawal of the connector from the channel.

2 Claims, 5 Drawing Figures

ELECTRIFIED CHANNEL WITH CORRESPONDING SNAP ACTING CONNECTOR

BACKGROUND OF THE INVENTION

In accordance with the prior art, electrical channel systems utilizing bars or rods on which the conductors, usually in the shape of flat wires are supported with their associated junction boxes are in general bulky. Furthermore, complicated devices are utilized to mount the junction boxes onto the bus bars. Additionally the bus bar devices of the prior art and their related junction boxes are specifically shaped with mutual engaging members in order to establish an interconnection of the junction boxes with the channel in only a single direction.

SUMMARY OF THE INVENTION

The electrified channel and corresponding snap acting connector in accordance with this invention has remarkable improvements over the equipment of the prior art. In particular the combined device permits for a universal connector providing the possibility of utilizing two different and independent circuits. Furthermore, there is an automatic retention of the connector in the channel without the necessity of utilizing locking members.

The electrified channel and snap acting connector in accordance with this invention are characterized in that the conductors advantageously in the form of bus bars are aligned and secured to an insulating body which is carried by the channel. The contacts of the connectors are carried within the connector housing and have coaxially supporting springs which are designed, when the connector is engaged with the channel, to exert a residual load on the inserted portion of the connector to keep it locked in the position and further to assist removal of the connector when it is to be disconnected.

DESCRIPTION OF THE PREFERRED EMBODIMENT

Figure 1:
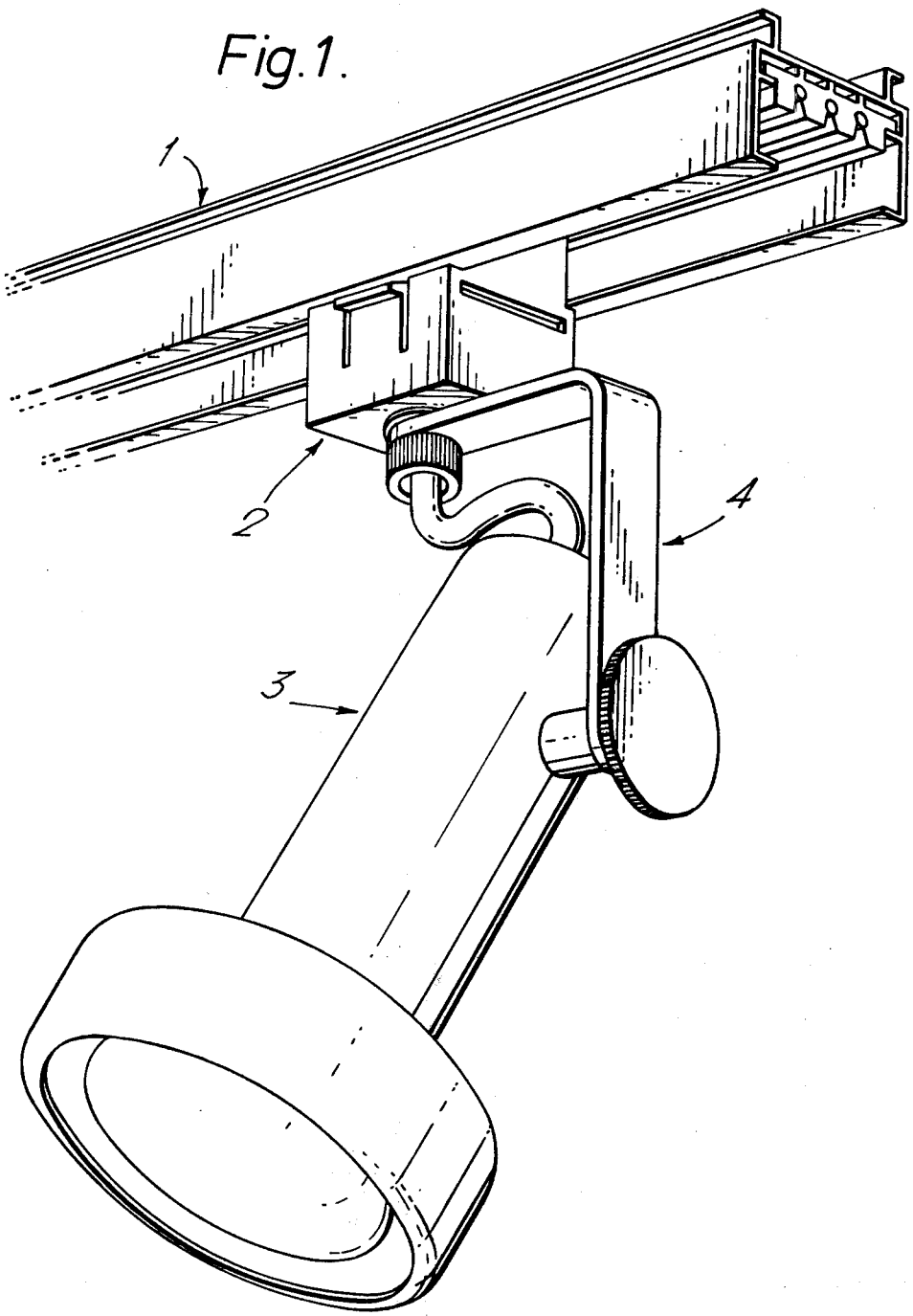
FIG. 1 is a perspective view showing the electrical channel and connector with an associated lamp.

Referring now to the Figures, the electrified channel of this invention is indicated generally by reference numeral 1. The channel 1 may be made of many materials but is preferably an aluminum section. The associated connector 2 is inserted into channel 1 and held therein by means to be described below. A lamp illustrated in perspective in FIG. 1 carried on a bracket and arm means 4 is attached to connector 2. Of course, it will be realized that any form of electrical appliances may be attached through connector 2 to channel 1.

Figure 2:
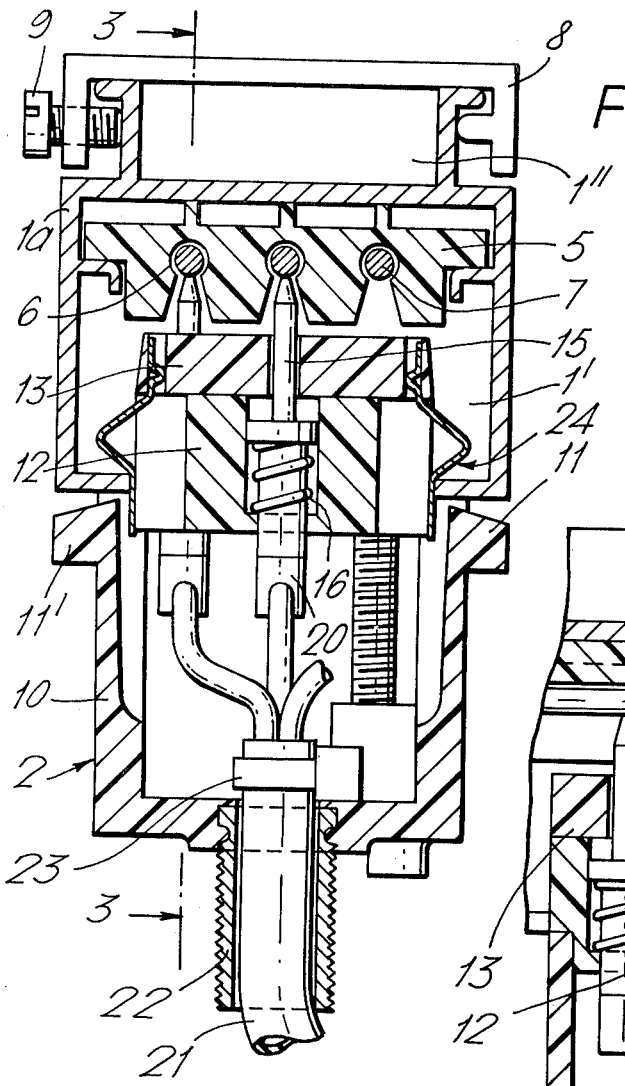
FIG. 2 is a cross-sectional view of the channel and connector of this invention taken on the line 2—2 of FIG. 3.
Figure 3:
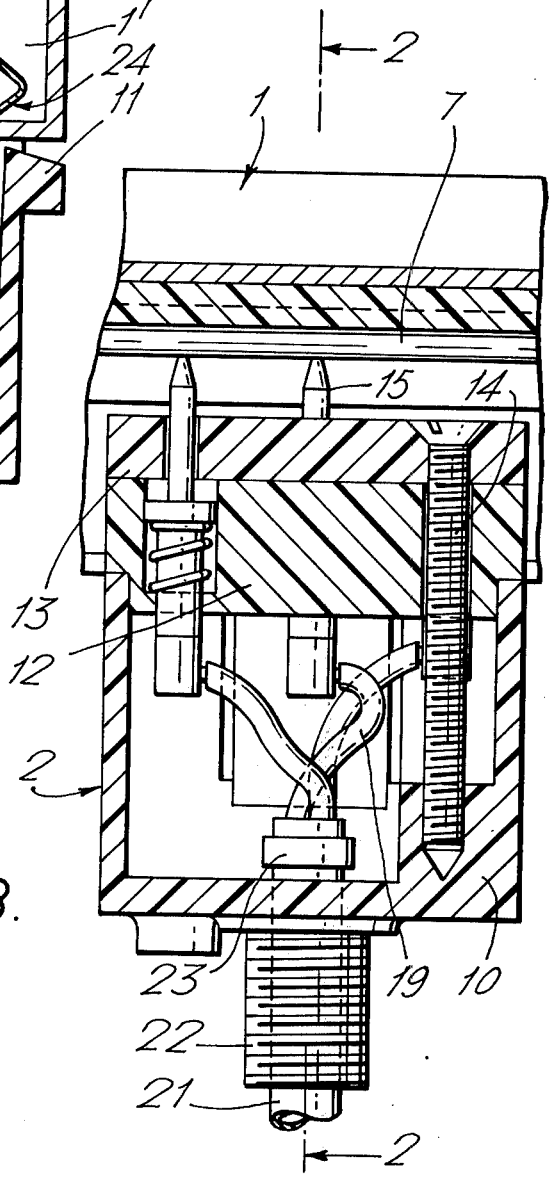
FIG. 3 is a cross-sectional view taken on the line 3—3 of FIG. 2.
Figure 4:
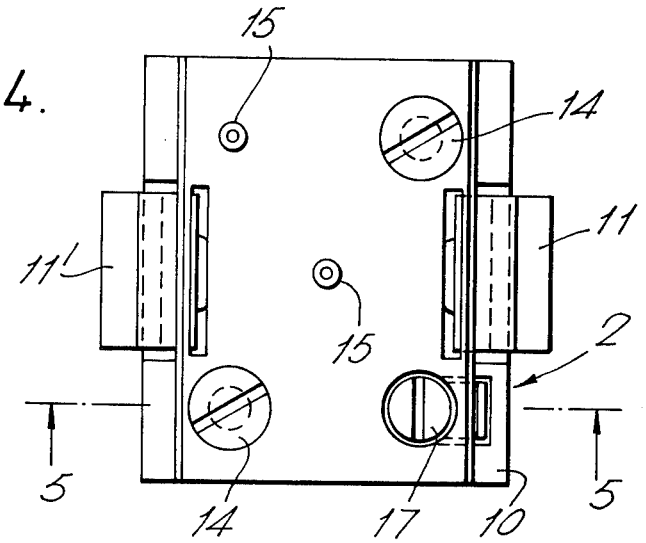
FIG. 4 is a plan view of the connector of this invention.
Figure 5:
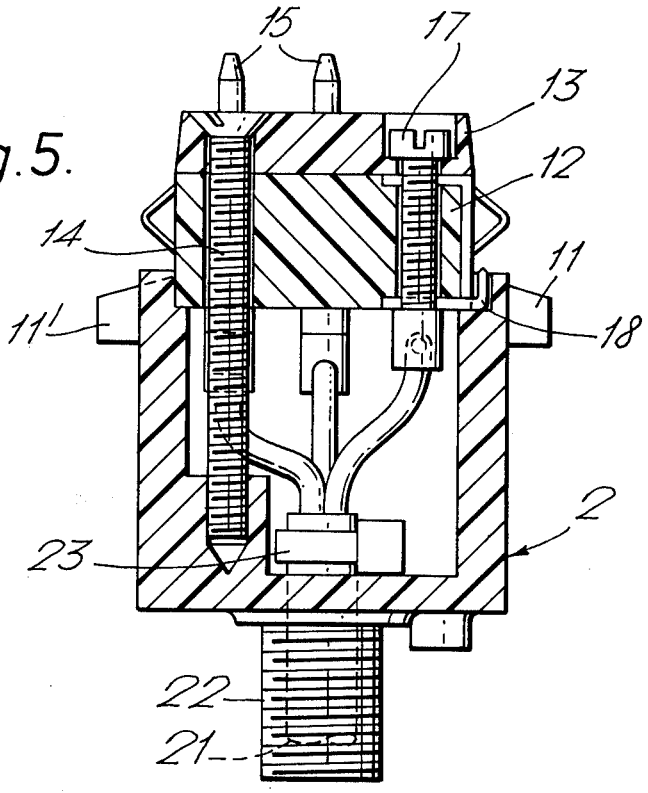
FIG. 5 is a section taken on line 5—5 of FIG. 4.

The channel 1 having a cross sectional shape as illustrated for example in FIG. 2, has a pair of spaces denoted by 1' and 1''. In the space 1', an insulating body is provided preferably made of extruded PVC which carries copper wire conductors 7 anchored therein. Cables or wires for different purposes and in particular for connection to conductor 7 may be accommodated in the space 1''. The channel 1 may be hung by a suspension device 8 or fitted as a ceiling appliance or even embedded into a chase. The provision of locking screw 9 allows for fitting the channel 1 into the suspension device 8 without the necessity of having it inserted at one end and slid into position. Once in the position in the device as illustrated in FIG. 2, the channel 1 is locked into position by tightening the screw 9. It will be appreciated that there is no limitation on the length of channel 1 since it can be made of abutted lengths of material, while the conductors 7 may be continuous or interconnected by intermediate terminals.

The three conductors 7 are arranged side by side. The middle conductor acts as a hot line while the side conductors act as neutral conductors of two distinct electrical circuits.

The connector 2 consists of a closing cap 10 with pawls 11 and 11' fitted on resilient portions as defined by slits on the two walls thereof.

Abutted against the top of cap 10 is the contact guiding body 12 along with its related cover 13 which is secured to cap 10 by self threading screws 14. Two contacts 15 fit slidingly in the body 12 which are aligned with each other and acted upon by biasing springs 16. In addition, a ground screw 17 is carried by the body 12. The ground screw 17 is connected to a ground contact spring 18.

Both the contacts 15 and the ground screw 17 are connected with the cables 19 by connecting terminals 10 while the outlet cable 21 is retained in cap 10 by cable fastening clip 23. The outlet cable 21 is carried through the base of cap 10 by the nipple 22. A support spring 24 allows for the snap insertion of connector 2 into channel 1 and for the consequent electrical connection between the contacts 15 with the conductors 7 under the action of biasing springs 16. The ground contact spring 18 electrically connects to the channel 1.

To disconnect connector 2 from channel 1, a pressure is exerted on the shoulders 11, 11' on the support spring 24. This permits the biasing spring 16, when completely released to cause a thrust of the contacts against channel 1 in the direction of the removal of the connector 2.

Due to the aligned arrangement of conductors 7 within channel 1 and of their contacts 15, and the ground connection 17 in connector 2, it is possible to have the same connector inserted into the channel in either direction by turning it 180° about its longitudinal axis. This allows the utilization of two independent circuits. This would be advantageous for example in providing one of the two circuits as an emergency circuit for night lighting and similar applications.

It will be appreciated by those skilled in the art that the above described embodiment is for illustration purposes only and that modifications can be made without departing from the scope of the appended claims.

I claim:

1. An electrified channel and snap acting connector therefor comprising:

a channel having a plurality of conductors mounted side by side in an insulating body within said channel;

said connector having mating contacts resiliently urged against said conductors when said connector is inserted into said channel;

said connector comprising a closing cap, a contact guiding body having a cover, resilient means for urging said contacts in said guiding body outwardly, a ground screw, a ground contact spring connected to said ground screw, and a connector body supporting spring on the exterior of said connector body inside said closing cap.

2. The device of claim 1 having slits in said closing cap to define elastically resilient portions having shoulders formed thereon and arranged to bear on said supporting spring.

* * * * *